US007374449B2

(12) United States Patent
Demuth et al.

(10) Patent No.: US 7,374,449 B2
(45) Date of Patent: May 20, 2008

(54) ELECTRICAL CONTACT ELEMENT AND CONTACT ARRANGEMENT

(75) Inventors: Ulrich Demuth, Erbach (DE); Rolf Hruby, Pforzheim (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 11/563,218

(22) Filed: Nov. 27, 2006

(65) Prior Publication Data

US 2007/0128919 A1 Jun. 7, 2007

(30) Foreign Application Priority Data

Dec. 1, 2005 (DE) ..... 10 2005 057 211

(51) Int. Cl.
*H01R 4/24* (2006.01)

(52) U.S. Cl. ..... 439/404

(58) Field of Classification Search ..... 439/402, 439/404, 825, 854, 595, 686
See application file for complete search history.

(56) References Cited

U.S. PATENT DOCUMENTS 3,820,058 A 6/1974 Friend
4,264,117 A 4/1981 Pritulsky
5,364,288 A 11/1994 Drewanz et al.
6,050,842 A 4/2000 Ferrill et al.

FOREIGN PATENT DOCUMENTS

| | | |
|---|---|---|
| DE | 27 12 895 A1 | 9/1978 |
| DE | 694 20 060 T2 | 5/2000 |
| EP | 1 225 656 A2 | 7/2002 |
| WO | WO 96/27925 | 9/1996 |

*Primary Examiner*—Alexander Gilman
(74) *Attorney, Agent, or Firm*—Barley Snyder LLC

(57) ABSTRACT

A contact arrangement comprises an electrical contact element including a plate member with a contact slot configured to receive an electrically insulated conductor. The plate member has first and second plate arms extending there from that delimit the contact slot. At least one retaining element extends from a plane of the plate member configured to secure the electrical contact element in a housing. The retaining element has first and second retaining surfaces arranged at a fixed angle to each other. The fixed angle is less than 180 degrees. A housing has a contact accommodating chamber that receives the electrical contact element. The contact accommodating chamber has first and second conductor receiving openings and a wall. The retaining element engaging the wall when the electrical contact element is positioned in the contact accommodating chamber.

20 Claims, 2 Drawing Sheets

ELECTRICAL CONTACT ELEMENT AND CONTACT ARRANGEMENT

FIELD OF THE INVENTION

The invention relates to an electrical contact element having a plate member with at least one retaining element extending from a plane of the plate member that is configured to secure the electrical contact element in a housing. The invention further relates to a contact arrangement containing the same.

BACKGROUND OF THE INVENTION

Electrical contact elements that are used for contacting an electrically insulated conductor are well known. For example, Tyco Electronics manufactures an electrical contact element known as MAG-MATE, which has a contact slot for contacting an electrically insulated conductor. When the electrically insulated conductor is inserted into the contact slot, the electrical insulation of the electrically insulated conductor is cut open by edges of the contact slot such that electrical contact is established between the electrically insulated conductor and the electrical contact element.

In order to ensure good electrical contact, the contact slot needs to have a width smaller than a diameter of the electrically insulated conductor after the insulation is removed. The electrical insulation can thereby be cut open when the electrically insulated conductor is inserted into the contact slot and direct contact between the electrical contact element and the electrically insulated conductor can be ensured. A disadvantage of this configuration, however, is that when the contact slot is expanded during insertion of the electrically insulated conductor, the geometry of the electrical contact element can be altered and/or compressive stresses can be created in the electrical contact element. If the electrical contact element has retaining elements with which the electrical contact element is secured inside a housing, there is therefore a danger that the engagement between the electrical contact element and the housing could be impaired through the compressive stresses and/or the alteration of the geometry of the electrical contact element.

A electrical contact element and a connector arrangement consisting of the electrical contact element and a housing is known from DE 197 43 328 A1. The electrical contact element has a substantially U-shaped insulation displacement region and a contacting region with two contacting arms, which are arranged with their edges positioned opposite each other. Each of the contact arms is constructed in two layers in a region of a contacting zone so that the edges of both layers contribute to a contacting process. The insulation displacement region comprises two insulation displacement terminals that are arranged parallel to each other and form the sides of the U-shaped insulation displacement region. The electrical contact element also has fastening devices for fastening the electrical contact element inside a contact receiving chamber of the housing. The fastening devices are arranged such that forces of the fastening devices on the housing and forces of the insulation displacement terminals on the housing run perpendicular to each other. The fastening devices are provided in a region of the insulation displacement terminals and just in front of the contacting region on both sides of the insulation displacement terminals and serve to fasten the electrical contact element inside the housing. The fastening devices are bent outwards by way of barbs from a plane of the insulation displacement terminals. To fasten the electrical contact element inside the housing, webs are provided on the housing into which the barbs of the electrical contact element engage when the electrical contact element is inserted into the contact receiving chamber of the housing.

BRIEF SUMMARY OF THE INVENTION

It is therefore an object of the invention to provide an improved electrical contact element with a contact slot, wherein a retaining function of the electrical contact element is less adversely affected by the insertion of the electrically insulated conductor.

This and other objects are achieved by an electrical contact element comprising a plate member with a contact slot configured to receive an electrically insulated conductor. The plate member has first and second plate arms extending there from that delimit the contact slot. At least one retaining element extends from a plane of the plate member configured to secure the electrical contact element in a housing. The retaining element has first and second retaining surfaces arranged at a fixed angle to each other. The fixed angle is less than 180 degrees.

This and other objects are further achieved by a contact arrangement comprising an electrical contact element including a plate member with a contact slot configured to receive an electrically insulated conductor. The plate member has first and second plate arms extending there from that delimit the contact slot. At least one retaining element extends from a plane of the plate member configured to secure the electrical contact element in a housing. The retaining element has first and second retaining surfaces arranged at a fixed angle to each other. The fixed angle is less than 180 degrees. A housing has a contact accommodating chamber that receives the electrical contact element. The contact accommodating chamber has first and second conductor receiving openings and a wall. The retaining element engaging the wall when the electrical contact element is positioned in the contact accommodating chamber.

DETAILED DESCRIPTION OF THE INVENTION

Figure 1:
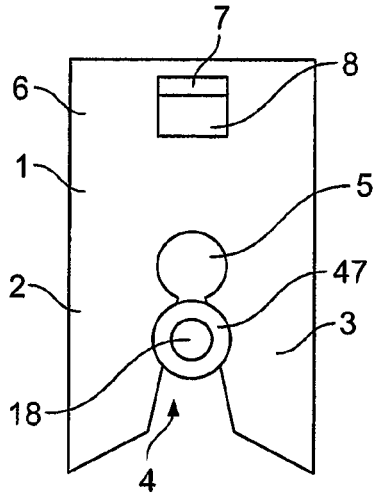
FIG. 1 is a schematic view of an electrical contact element according to a first embodiment of the invention.
Figure 4:
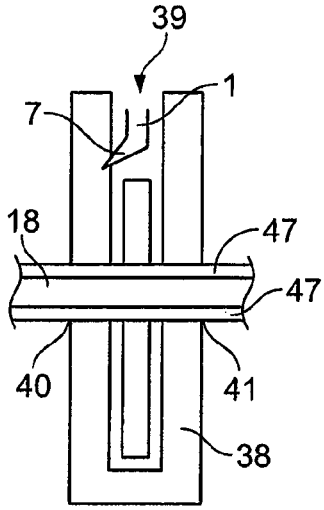
FIG. 4 is a schematic sectional view of a contact arrangement with the electrical contact element of FIG. 1.

FIG. 1 shows an electrical contact element 1 according to a first embodiment of the invention. The electrical contact element 1 may be formed, for example, by stamping a plate. As shown in FIG. 1, the electrical contact element 1 has a contact slot 4 opening downwards, which terminates at a substantially rounded opening 5. First and second plate arms 2, 3 are attached at a top of the contact slot 4 and extend on both sides thereof to form a plate member 6. Side edges of the first and second plate arms 2, 3 delimit the contact slot 4. A retaining element 7 is bent outwards from a plane of the plate member 6 substantially above the opening 5. The retaining element 7 is configured to retain the electrical contact element 1 when the first electrical contact element 1 is fastened inside a housing 38 (FIG. 4). The retaining element 7 may be, for example, stamped out of the plate member 6 such that an opening 8 is formed. The retaining element 7 may be formed, for example, as a tongue, a retaining lug, or a spike. Because the retaining element 7 is arranged above the contact slot 4 and projects from the plane of the plate member 6, the form and position of the retaining element 7 is not changed when either an electrically insulated conductor 18 is inserted into the contact slot 4 causing the first and second plate arms 2, 3 to deflect laterally or when electrical insulation 47 of the electrically insulated conductor 18 is cut open.

Figure 2:
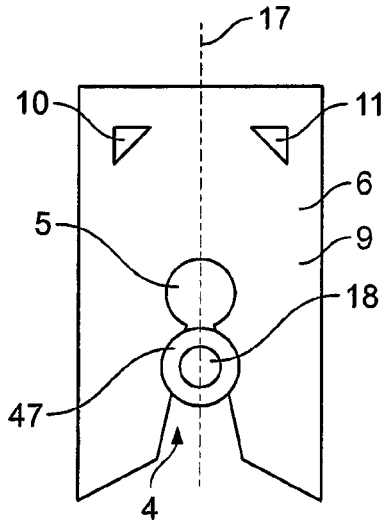
FIG. 2 is a schematic view of an electrical contact element according to a second embodiment of the invention.

FIG. 2 shows an electrical contact element 9 according to a second embodiment of the invention. The electrical contact element 9 may be formed, for example, by stamping a plate. As shown in FIG. 2, the electrical contact element 9 has a plate member 6 with a contact slot 4 opening downwards, which terminates at a substantially rounded opening 5. Retaining elements 10, 11 are arranged above the opening 5 in opposite edges of the plate member 6. In the illustrated embodiment, the retaining elements 10, 11 are arranged symmetrically about a longitudinal axis 17 of the contact slot 4. Because of the positioning of the retaining elements 10, 11, an even distribution of the retaining forces is achieved when the electrical contact element 9 is inserted into a housing. The retaining elements 10, 11 may be stamped and bent outwards from a plane of the plate member 6. Alternatively, the retaining elements 10, 11 may be worked out of the plate member 6 using a stamping process. The retaining elements 10, 11 may be formed, for example, as tongues.

Figure 3:
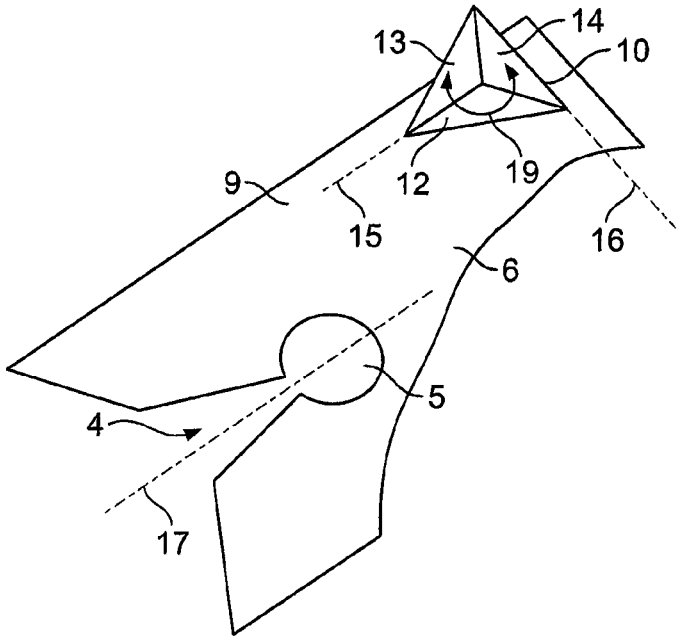
FIG. 3 is a perspective view of the electrical contact element of FIG. 2.

As shown in FIG. 3, during the stamping process, an embossment resulting from the stamping process projects outwards from the plane of the plate member 6 and an indentation or a stamped opening 12 is constructed in the plate member 6. In the illustrated embodiment, the retaining element 10 was stamped out of the plate member 6 using a forming die to form an embossment having first and second retaining surfaces 13, 14 arranged at a fixed angle of less than 180 degrees to each other. The first and second retaining surfaces 13, 14 form an angled retaining lug. The first retaining surface 13 is aligned along a first axis 15 that extends parallel to the longitudinal axis 17 of the contact slot 4, and the second retaining surface 14 is aligned along a second axis 16 that extends perpendicular to the longitudinal axis 17 of the contact slot 4. The first and second retaining surfaces 13, 14 are connected to each other via a connecting line in a connection region. The first and second retaining surfaces 13, 14 extend from the surface of the plate member 6 and rise to a maximum height in the connecting region. An angle 19 between the first and second retaining surfaces 13, 14 is preferably about 90 degrees. The first and second retaining surfaces 13, 14 fix the electrical contact element 9 inside the housing such that movement perpendicular to the first axis 15 and the second axis 16 is prevented. Alternatively, the retaining elements 10, 11 may be formed to have a simpler configuration, such as a spike stamped out of the plate member 6 or two spaced parts.

FIG. 4 shows a contact arrangement consisting of the housing 38 provided with the electrical contact element 1 according to the first embodiment. The housing 38 has a contact accommodating chamber 39. First and second conductor receiving openings 40, 41 are provided on opposite sides of the contact accommodating chamber 39. The electrically insulated conductor 18 is pushed through the first and a second conductor receiving openings 40, 41. The electrical contact element 1 is then plugged into the contact accommodating chamber 39 from above so that the electrically insulated conductor 18 is inserted into the contact slot 4 and the electrical insulation 47 of the electrically insulated conductor 18 is cut open by the side edges of the contact slot 4. A mechanical and electrically conductive connection is thereby established between the electrical contact element 1 and the electrically insulated conductor 18.

The retaining element 7 engages a wall of the contact accommodating chamber 39 when the electrical contact element 1 is inserted therein. For example, the retaining element 7 may penetrate the material of the wall when the electrical contact element 1 is inserted in the contact accommodating chamber 39. The housing 38 is preferably made from a flexible plastic material, so that the retaining element 7 can effectively penetrate the plastic material and establish an interlocking connection therewith. The retaining element is thereby frictionally and/or positively secured in the housing 38. Additionally, the wall can be deformed or cut through in the process to accommodate the retaining element 7. Depending on the hardness of the material of the wall, a clamping retention can also be established by the retaining element 7 whereby the retaining element 7 does not penetrate the wall. The retaining element 7 thereby prevents movement of the electrical contact element 1 with respect to the housing 38 so that electrical contact between the electrically insulated conductor 18 and the electrical contact element 1 is ensured. The electrical contact element 1 can also be further connected to another electrical conductor via a plug-in or solder connection so that an electrical connection is established between the electrically insulated conductor 18 and the other conductor.

The electrical contact element 9 according to the second embodiment can be inserted into the contact accommodating chamber 39 of the housing 38 in the same manner as the electrical contact element 1 according to the first embodiment. The retaining elements 10, 11 of the electrical contact element 9 similarly engage the wall of the housing 38 when the electrical contact element 9 is inserted into the contact accommodating chamber 39. The retaining elements 10, 11 secure the electrical contact element 9 inside the housing 38 in both the insertion direction of the electrical contact element 9 into the contact accommodating chamber 39 and perpendicular to the insertion direction of the electrical contact element 9 into the contact accommodating chamber 39.

Figure 5:
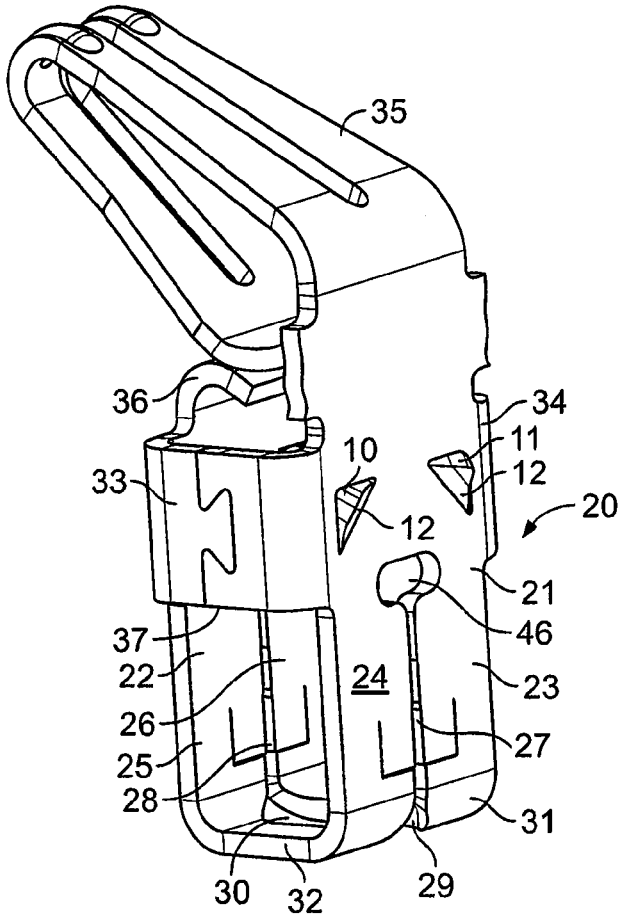
FIG. 5 is a perspective view of an electrical contact element according to a third embodiment of the invention.

FIG. 5 shows an electrical contact element 20 according to a third embodiment of the invention. The third electrical contact element 20 has first and second plates members 21, 22 arranged substantially parallel to each other. The first plate member 21 has a contact slot 27, which is delimited by first and second plate arms 23, 24. The contact slot 27 terminates at a substantially rounded opening 46. The second plate member 22 has a contact slot 28, which is delimited by third and fourth plate arms 25, 26. The contact slot 28 is arranged substantially parallel to the contact slot 27. The contact slot 27 terminates at a substantially rounded opening. Depending on the embodiment, the contact slot 28 may be formed identical to the contact slot 27 or may be formed to have a larger slot aperture so that an electrically insulated conductor 18 can be guided therein without damaging electrical insulation 47 of the electrically insulated conductor 18.

The first plate arm 23 is connected to the fourth plate arm 26 via a first bent portion 31. In the illustrated embodiment, the first plate arm 23, the first bent portion 31, and the fourth plate arm 26 are constructed in one piece. The second plate arm 24 is connected to the third plate arm 25 via a second bent portion 32. In the illustrated embodiment, the second plate arm 24, the second bent portion 32, and the third plate arm 25 are constructed in one piece. The first and second bent portions 31, 32 are preferably constructed in the form of two partial portions, which are connected to each other frictionally or in an interlocking manner. Insertion openings 29, 30 are formed between the first and second bent portions 31, 32. The insertion openings 29, 30 are constructed so as to converge towards the contact slots 27, 28, respectively.

The first and second plate members 21, 22 are connected in an upper plate region via first and second connecting strips 33, 34. The first and second connecting strips 33, 34 extend laterally outwards from the upper plate regions of the first and second plate members 21, 22. The first and second connecting strips 33, 34 each have a lower edge region that can serve as a stop element 37. A spring contact 35 of substantially U-shaped construction is attached, pointing upwards to the first plate member 21. A free end of the spring contact 35 is bent backwards, towards an upper region of the second plate member 22 and rests on a supporting spring portion 36. The supporting spring portion 36 extends upwards out of the upper plate region of the second plate member 22 and is bent backwards and inwards towards the first plate member 21. The spring contact 35 includes a slot defining two substantially U-shaped members formed side by side.

The first plate member 21 has retaining elements 10, 11 formed therein. The retaining elements 10, 11 are arranged symmetrically about a longitudinal axis of the contact slot 27. The retaining elements 10, 11 are constructed in the form of embossments. At least one of the retaining elements 10, 11 has retaining surfaces 13, 14, which are arranged at a fixed angle 19 to each other, for example, 90 degrees, as shown in FIG. 3. Alternatively, the retaining elements 10, 11 are arranged opposite the longitudinal axis of the contact slot 27 such that the retaining surfaces 14 of the retaining elements 10, 11 are arranged on the longitudinal axis of the contact slot 27 and the retaining surfaces 13 of the retaining elements 10, 11 are arranged parallel to each other. Openings 12, which are preferably substantially triangular in shape, are introduced via a stamping process into the upper plate region of the first plate member 21 adjacent to the retaining elements 10, 11. The torsional strength of the plate region is increased by the stamping of the retaining elements 10, 11. The triangular shape of the opening 12 additionally increases the rigidity of the plate region.

Figure 6:
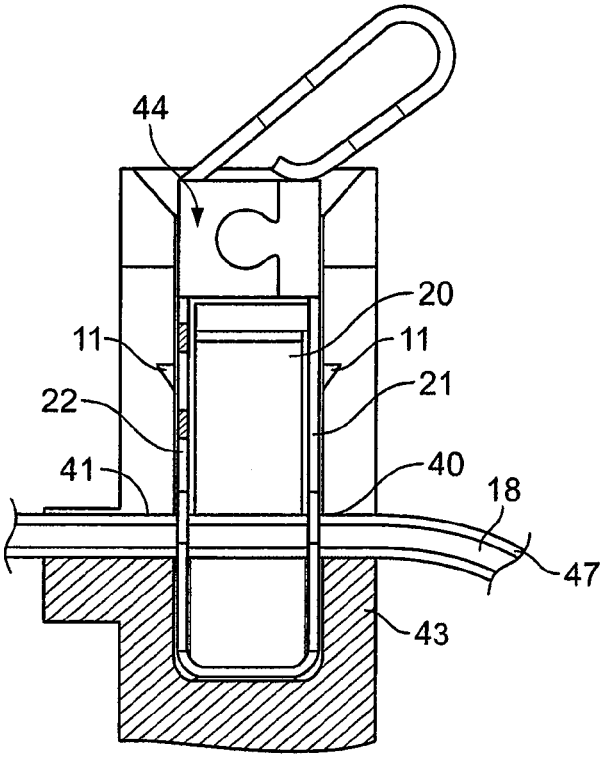
FIG. 6 is a sectional view of a contact arrangement with the electrical contact element of FIG. 5.
Figure 7:
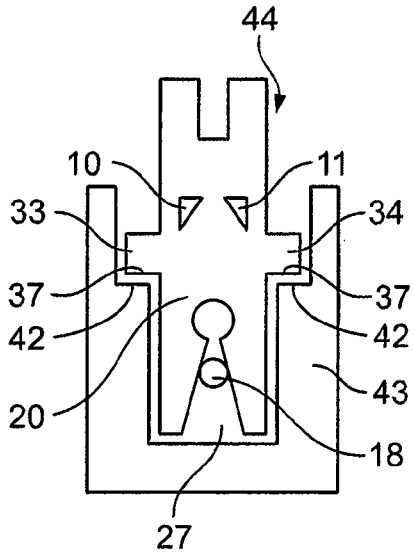
FIG. 7 is a schematic sectional view of a contact arrangement with the electrical contact element of FIG. 5.

As shown in FIG. 6-7, the second plate member 22 has retaining elements 10, 11 formed therein. Because the retaining elements 10, 11 of the second plate member 22 are constructed identically to the retaining elements 10, 11 of the first plate member 21 and are arranged symmetrically thereto further description thereof has been omitted.

FIG. 6 shows a contact arrangement consisting of a housing 43 provided with the electrical contact element 20 according to the third embodiment. The housing 38 has a contact accommodating chamber 44 that receives the electrical contact element 20. The contact accommodating chamber 44 is open in an upper region of the housing 42 and has substantially the same cross-section as the electrical contact element 20. The electrically insulated conductor 18 is guided through the second housing 43 via first and second conductor receiving openings 40, 41. The electrically insulated conductor 18 rests on supporting surfaces of the housing 43 in regions of the first and second conductor receiving openings 40, 41. The electrical contact element 20 is then pushed over the electrically insulated conductor 18 so that the electrically insulated conductor 18 is introduced into the contact slots 27, 28. During this process, the electrical insulation 47 of the electrically insulated conductor 18 is cut open by the side edges of the contact slot 27 so that a mechanical and electrically conductive connection is established between the electrical contact element 20 and the electrically insulated conductor 18. At least the contact slot 27 expands when the conductor 18 is inserted for good electrical contact.

The electrical contact element 20 is simultaneously secured to walls of the housing 43 via the retaining elements 10, 11 of the first and second plate members 21, 22. Due to the shape and position of the retaining elements 10, 11 on the first and second plate members 21, 22, the fastening of the electrical contact element 20 to the housing 43 is not adversely affected by the expansion of the contact slot 27 or the introduction of bias into the region of the contact slot 27.

As shown in FIG. 7, the stop elements 37 of the first and second connecting strips 33, 34 abut support edges 42 in the housing 43 when the electrical contact element 20 is inserted therein. A maximum insertion depth of the electrical contact element 20 is thereby fixed. By restricting the maximum insertion depth, the electrically insulated conductor 18 is prevented from being cut too deeply by the contact slot 27. Damage to the electrically insulated conductor 18 and excessive expansion or excessive bias into the contact slot 27 of the first plate member 21 is thus avoided.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. An electrical contact element, comprising:

a plate member with a contact slot configured to receive an electrically insulated conductor, the plate member having first and second plate arms extending there from that delimit the contact slot; and at least one substantially triangular retaining element extending from a plane of the plate member configured to secure the electrical contact element in a housing, the retaining element having first and second retaining surfaces arranged at a fixed angle to each other of less than 180 degrees, the first retaining surface being arranged parallel to a longitudinal axis of the contact slot and the second retaining surface being arranged perpendicular to the longitudinal axis of the contact slot.

2. The electrical contact element of claim 1, wherein the retaining element is an embossment.

3. The electrical contact element of claim 1, wherein the plate member includes two of the retaining elements, the retaining members being symmetrically arranged with respect to the longitudinal axis of the contact slot.

4. The electrical contact element of claim 1, wherein the first and second retaining surfaces are connected in a connecting region, the first and second retaining surfaces being inclined and having a maximum height from a surface of the plate member in the connecting region.

5. The electrical contact element of claim 1, wherein the plate member has a substantially triangular opening adjacent to the retaining element.

6. The electrical contact element of claim 1, further comprising a second plate member arranged substantially parallel to the plate member, the second plate member being connected to the plate member by at least one connecting strip.

7. The electrical contact element of claim 6, wherein the second plate member has a contact slot arranged parallel to the contact slot of the plate member that is configured to receive an electrically insulated conductor, the second plate member having first and second plate arms extending there from that delimit the contact slot of the second plate member.

8. The electrical contact element of claim 6, further comprising a spring contact that extends from the plate member.

9. The electrical contact element of claim 6, wherein the second plate member has at least one retaining element extending from a plane of the second plate member.

10. A contact arrangement, comprising:

an electrical contact element including a plate member with a contact slot configured to receive an electrically insulated conductor, the plate member having first and second plate arms extending there from that delimit the contact slot;

at least one substantially triangular retaining element extending from a plane of the plate member configured to secure the electrical contact element in a housing, the retaining element having first and second retaining surfaces arranged at a fixed angle to each other of less than 180 degrees, the first retaining surface being arranged parallel to a longitudinal axis of the contact slot and the second retaining surface being arranged perpendicular to the longitudinal axis of the contact slot; and a housing having a contact accommodating chamber that receives the electrical contact element, the contact accommodating chamber having first and second conductor receiving openings and a wall, the retaining element engaging the wall when the electrical contact element is positioned in the contact accommodating chamber.

11. The contact arrangement of claim 10, wherein the retaining element is an embossment.

12. The contact arrangement of claim 10, wherein the plate member includes two of the retaining elements, the retaining members being symmetrically arranged with respect to longitudinal axis of the contact slot.

13. The contact arrangement of claim 10, wherein the housing is made of a flexible plastic material.

14. The contact arrangement of claim 10, wherein the retaining element penetrates the wall of the housing.

15. The contact arrangement of claim 10, wherein the housing includes support edges that abut stop elements on the electrical contact element that fix the electrical contact element at a maximum insertion depth.

16. The contact arrangement of claim 10, wherein the first and second retaining surfaces are connected in a connecting region, the first and second retaining surfaces being inclined and having a maximum height from a surface of the plate member in the connecting region.

17. The contact arrangement of claim 10, further comprising a second plate member arranged substantially parallel to the plate member, the second plate member being connected to the plate member by at least one connecting strip.

18. The contact arrangement of claim 17, wherein the second plate member has a contact slot arranged parallel to the contact slot of the plate member that is configured to receive an electrically insulated conductor, the second plate member having first and second plate arms extending there from that delimit the contact slot of the second plate member.

19. The contact arrangement of claim 17, further comprising a spring contact that extends from the plate member.

20. The contact arrangement of claim 17, wherein the second plate member has at least one retaining element extending from a plane of the second plate member.

* * * * *